US005845335A

United States Patent [19]

Twitty

[11] Patent Number: 5,845,335

[45] Date of Patent: Dec. 8, 1998

[54] NOISE MAKING GARMENT

[76] Inventor: Floleather Twitty, 203 W. Greenwood St., Landrum, S.C. 29356

[21] Appl. No.: 992,560

[22] Filed: Dec. 17, 1997

[51] Int. Cl.[6] ..... A41D 11/00

[52] U.S. Cl. ..... 2/80; 2/23; 2/24; 2/79; 2/267; 2/125; 446/26; 36/139

[58] Field of Search ..... 2/22, 24, 80, 83, 2/111, 16, 59, 23, 125, 227, 267, 79, 62, 115; 446/26, 28; 36/112, 139, 9 R

[56] References Cited

U.S. PATENT DOCUMENTS

| | | | |
|---|---|---|---|
| 2,929,072 | 3/1960 | Heilbronner | 2/83 |
| 3,411,222 | 11/1968 | Williams | 2/24 |
| 3,501,144 | 3/1970 | Schmidt | 273/1 |
| 3,593,340 | 7/1971 | Powell | 2/24 |
| 3,777,310 | 12/1973 | Yang | 46/175 |
| 4,253,254 | 3/1981 | Gill | 36/139 |
| 4,787,100 | 11/1988 | Jonat | 2/83 |
| 4,805,239 | 2/1989 | Ciago | 2/24 |
| 4,845,778 | 7/1989 | Peterson | 2/24 |
| 4,879,765 | 11/1989 | Bailie et al. | 2/24 |
| 5,105,473 | 4/1992 | Valtakari | 2/24 |
| 5,209,691 | 5/1993 | Ekstein | 2/18 |
| 5,285,585 | 2/1994 | Baker | 36/139 |
| 5,592,689 | 1/1997 | Matthews | 2/23 |

*Primary Examiner*—Amy Vanatta

[57] ABSTRACT

A new noise making garment for producing sounds when noise pads are compressed as well as providing reinforced areas where wear is likely to occur. The inventive device includes a garment with a plurality of noise pads coupled to the garment. Each noise pad comprises a deformable bladder with a flexible wall that permits deformation of the bladder. The flexible wall defines an interior air chamber that holds air. A valve with a noise making device extends through the flexible wall of the bladder to permit the passage of air from the interior air chamber through the valve when the bladder is deformed. The noise making device creates an audible sound when air passes through the valve. Preferably, a noise pad is located at each knee region towards the front of the garment, at each elbow region towards the back of the garment, and at each sole region. Ideally, a reinforcement layer surrounds the outer surface of each noise pad that is located at the knee regions and at the elbow regions. Also ideally, each sole region further includes a non-slip rubber layer that surrounds the outer surface of the noise pad.

11 Claims, 2 Drawing Sheets

NOISE MAKING GARMENT

BACKGROUND OF THE INVENTION

1. Field of the Invention

The present invention relates to garments and more particularly pertains to a new noise making garment for producing sounds when noise pads are compressed as well as providing reinforced areas where wear is likely to occur.

2. Description of the Prior Art

The use of garments is known in the prior art. More specifically, garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art garments include U. S. Pat. No. 4,787,100; U.S. Pat. No. 4,843,648; U.S. Pat. No. 4,488,314; U.S. Pat. No. 4,613,991; U.S. Pat. No. Des. 325,459; and U.S. Pat. No. 5,058,208.

While these devices fulfill their respective, particular objectives and requirements, the aforementioned patents do not disclose a new noise making garment. The inventive device includes a garment with a plurality of noise pads coupled to the garment. Each noise pad comprises a deformable bladder with a flexible wall that permits deformation of the bladder. The flexible wall defines an interior air chamber that holds air. A valve with a noise making device extends through the flexible wall of the bladder to permit the passage of air from the interior air chamber through the valve when the bladder is deformed. The noise making device creates an audible sound when air passes through the valve. Preferably, a noise pad is located at each knee region towards the front of the garment, at each elbow region towards the back of the garment, and at each sole region. Ideally, a reinforcement layer surrounds the outer surface of each noise pad that is located at the knee regions and at the elbow regions. Also ideally, each sole region further includes a non-slip rubber layer that surrounds the outer surface of the noise pad.

In these respects, the noise making garment according to the present invention substantially departs from the conventional concepts and designs of the prior art, and in so doing provides an apparatus primarily developed for the purpose of producing sounds when noise pads are compressed as well as providing reinforced areas where wear is likely to occur.

SUMMARY OF THE INVENTION

In view of the foregoing disadvantages inherent in the known types of garments now present in the prior art, the present invention provides a new noise making garment construction wherein the same can be utilized for producing sounds when noise pads are compressed as well as providing reinforced areas where wear is likely to occur.

The general purpose of the present invention, which will be described subsequently in greater detail, is to provide a new noise making garment apparatus and method which has many of the advantages of the garments mentioned heretofore and many novel features that result in a new noise making garment which is not anticipated, rendered obvious, suggested, or even implied by any of the prior art garments, either alone or in any combination thereof.

To attain this, the present invention generally comprises a garment with a plurality of noise pads coupled to the garment. Each noise pad comprises a deformable bladder with a flexible wall that permits deformation of the bladder. The flexible wall defines an interior air chamber that holds air. A valve with a noise making device extends through the flexible wall of the bladder to permit the passage of air from the interior air chamber through the valve when the bladder is deformed. The noise making device creates an audible sound when air passes through the valve. Preferably, a noise pad is located at each knee region towards the front of the garment, at each elbow region towards the back of the garment, and at each sole region. Ideally, a reinforcement layer surrounds the outer surface of each noise pad that is located at the knee regions and at the elbow regions. Also ideally, each sole region further includes a non-slip rubber layer that surrounds the outer surface of the noise pad.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is either intended to define the invention of the application, which is measured by the claims, nor is it intended to be limiting as to the scope of the invention in any way.

It is therefore an object of the present invention to provide a new noise making garment apparatus and method which has many of the advantages of the garments mentioned heretofore and many novel features that result in a new noise making garment which is not anticipated, rendered obvious, suggested, or even implied by any of the prior art garments, either alone or in any combination thereof.

It is another object of the present invention to provide a new noise making garment which may be easily and efficiently manufactured and marketed.

It is a further object of the present invention to provide a new noise making garment which is of a durable and reliable construction.

An even further object of the present invention is to provide a new noise making garment which is susceptible of a low cost of manufacture with regard to both materials and labor, and which accordingly is then susceptible of low prices of sale to the consuming public, thereby making such noise making garment economically available to the buying public.

Still yet another object of the present invention is to provide a new noise making garment which provides in the apparatuses and methods of the prior art some of the advantages thereof, while simultaneously overcoming some of the disadvantages normally associated therewith.

Still another object of the present invention is to provide a new noise making garment for producing sounds when noise pads are compressed as well as providing reinforced areas where wear is likely to occur.

Yet another object of the present invention is to provide a new noise making garment which includes a garment with a plurality of noise pads coupled to the garment. Each noise pad comprises a deformable bladder with a flexible wall that permits deformation of the bladder. The flexible wall defines an interior air chamber that holds air. A valve with a noise making device extends through the flexible wall of the bladder to permit the passage of air from the interior air chamber through the valve when the bladder is deformed. The noise making device creates an audible sound when air passes through the valve. Preferably, a noise pad is located at each knee region towards the front of the garment, at each elbow region towards the back of the garment, and at each sole region. Ideally, a reinforcement layer surrounds the outer surface of each noise pad that is located at the knee regions and at the elbow regions. Also ideally, each sole region further includes a non-slip rubber layer that surrounds the outer surface of the noise pad.

Still yet another object of the present invention is to provide a new noise making garment that provides reinforcement layers in the areas of greatest wear.

Even still another object of the present invention is to provide a new noise making garment that amuses and entertains a wearer by producing sounds.

Even still another object of the present invention is to provide a new noise making garment that allows parents or guardians to quickly locate their children.

These together with other objects of the invention, along with the various features of novelty which characterize the invention, arc pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
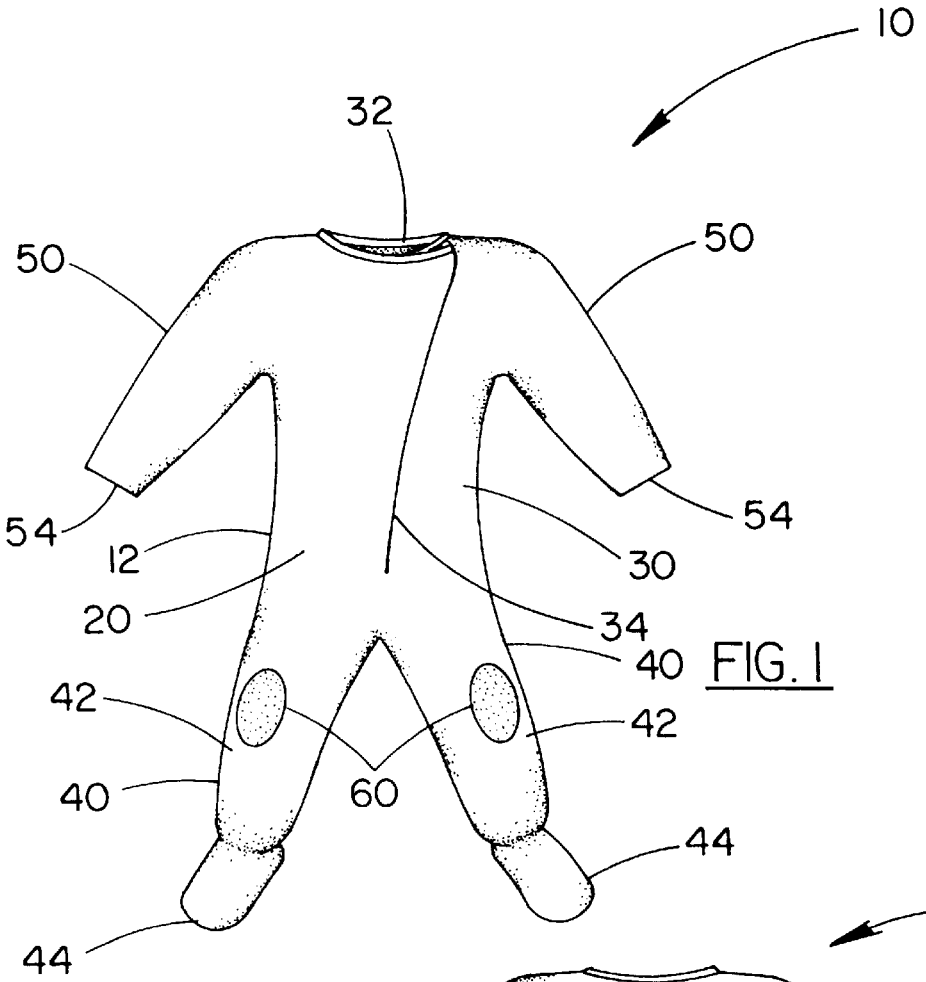
FIG. 1 is a side view of the front of a new noise making garment according to the present invention.

With reference now to the drawings, and in particular to FIGS. 1 through 4 thereof, a new noise making garment embodying the principles and concepts of the present invention and generally designated by the reference numeral 10 will be described.

As best illustrated in FIGS. 1 through 4, the noise making garment 10 comprises a garment 12 with a plurality of noise pads 60 coupled to the garment 12. Each noise pad 60 comprises a deformable bladder 62 with a flexible wall 64 that permits deformation of the bladder 62. The flexible wall 64 defines an interior air chamber 66 that holds air. A valve 70 with a noise making device (not shown) extends through the flexible wall 64 of the bladder 62 to permit the passage of air from the interior air chamber 66 through the valve 70 when the bladder 62 is deformed. The noise making device creates an audible sound when air passes through the valve 70.

Preferably, the garment includes a front 20, a back 22, a body portion 30, a pair of leg portions 40, and a pair of arm portions 50. The body portion 30 includes a neck opening 32 and an elongate closable body opening 34 that extends from the neck opening 32 in the front 20 of the garment 12. Each leg portion 40 has a knee region 42 and a foot portion 44 extending from it. Each foot portion 44 has a sole region 46. Each arm portion 50 has an elbow region 52 and a hand opening 54. A plurality of noise pads 60 are coupled to the garment 12.

Figure 2:
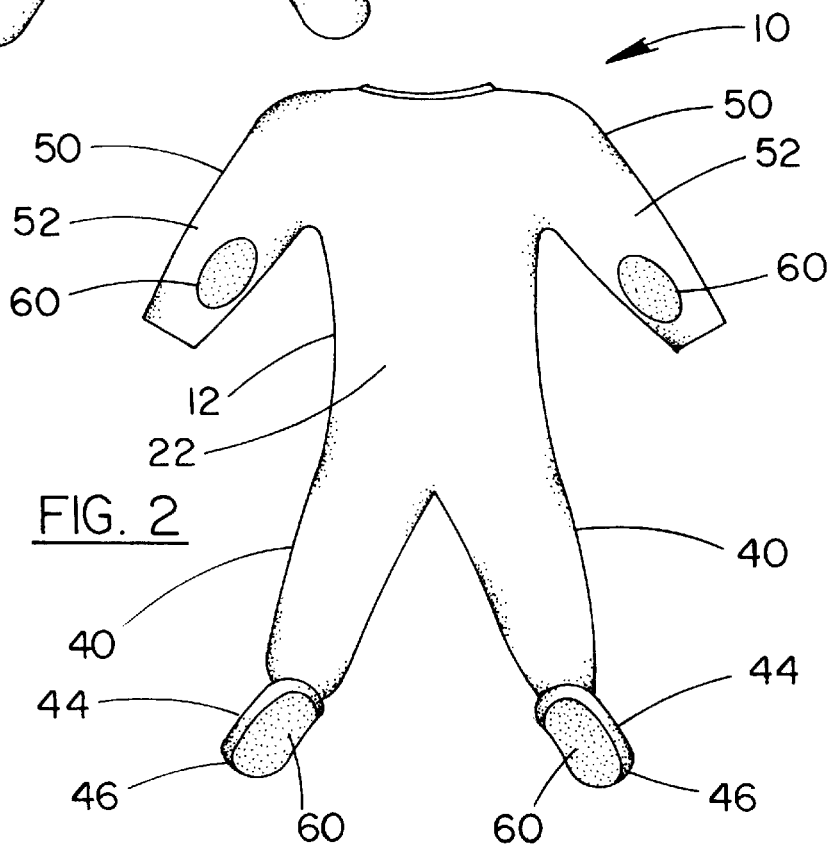
FIG. 2 is a side view of the back of the present invention.
Figure 3:
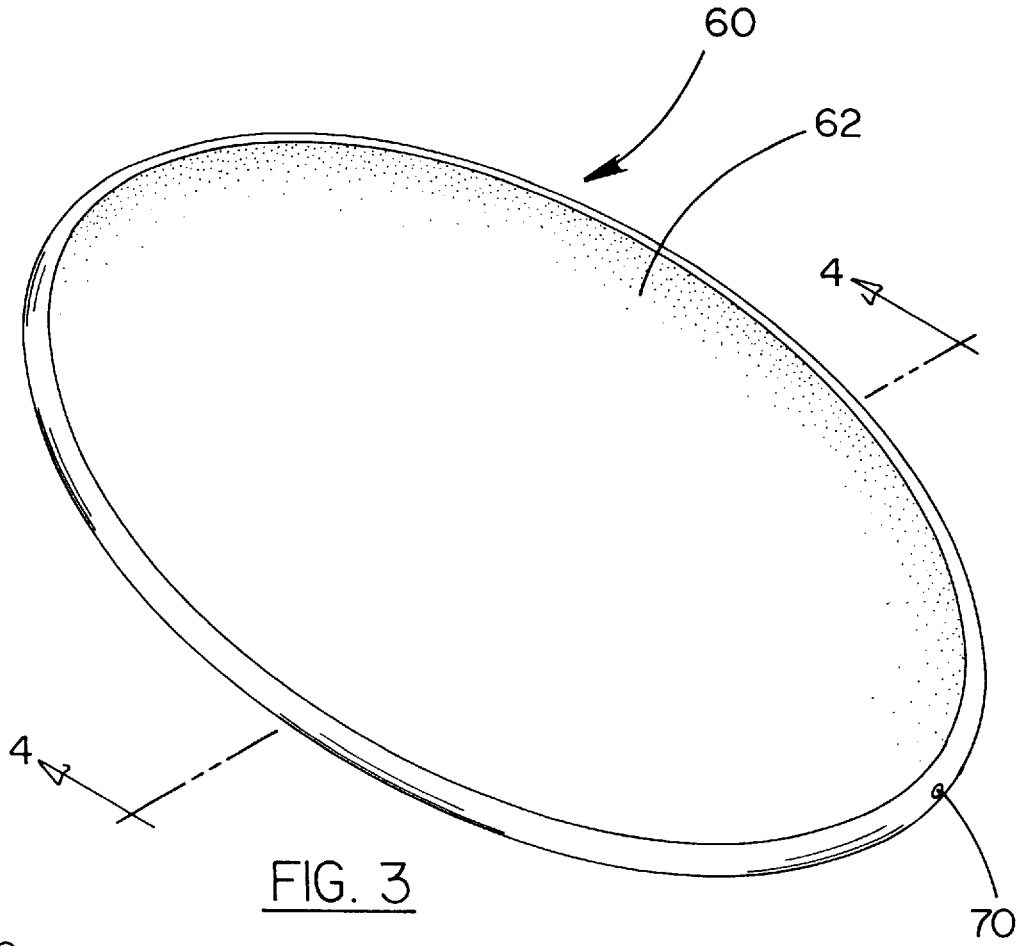
FIG. 3 is a perspective view of a noise pad of the present invention.
Figure 4:
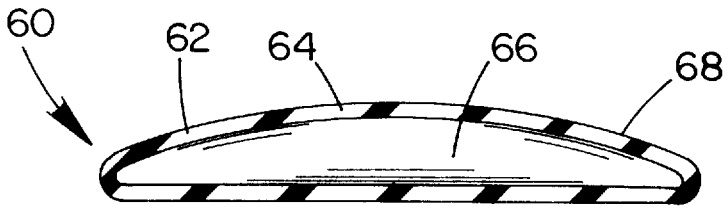
FIG. 4 is a cross-sectional view of the present invention taken from Line 4—4 of FIG. 3.

Preferably, as shown in FIG. 1, a noise pad 60 is located at each knee region 42 towards the front 20 of the garment 12. Also preferably, as shown in FIG. 2, a noise pad 60 is located at each elbow region 52 towards the back 22 of the garment 12. A noise pad 60 is located at each sole region 46.

Ideally, a reinforcement layer surrounds the outer surface 68 of each noise pad 60 that is located at the knee regions 42 and at the elbow regions 52. The reinforcement layers provide added durability and longer garment life.

Also ideally, each sole region 46 further includes a rubber layer that surrounds the outer surface 68 of the noise pad 60. The non-slip property of the rubber layer helps provide safety and stability as well as providing added durability.

In use, a wearer's feet are slipped into the leg portions 40. His or her arms are inserted into the arm portions 50. The body opening 34 is closed. The noise pads 60 emit sounds when the wearer's foot, knee or elbow presses against a noise pad 60, thereby forcing air out of the noise pad interior air chamber 66 and through the valve 70. The reinforcement layers prevent the elbow regions 52 and the knee regions 42 from wearing out. The rubber layers on the sole regions provide greater stability on slippery floor surfaces.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A noise making garment, comprising:

a garment having an exterior, a front, a back, a body portion, a pair of leg portions, and a pair of arm portions, said body portion having a neck opening and an elongate closable body opening extending from said neck opening in said front of said garment, each said leg portion having a knee region and a foot portion extending therefrom, each said foot portion having a sole region, each said arm portion having an elbow region and a hand opening;

a plurality of noise pads being fixedly coupled to said exterior of said garment, each of said noise pads having an outer surface;

wherein one of said noise pads is located at each said elbow region towards said back of said garment;

wherein one of said noise pads is located at each said sole region;

wherein each said noise pad comprises a deformable bladder having a flexible wall for permitting deformation of said bladder;

said flexible wall of said bladder defining an interior air chamber for holding air;

said flexible wall of said bladder having a valve extending therethrough, said valve permitting the passage of air from said interior air chamber through said valve when said bladder is deformed; and said valve including a noise making device for creating an audible sound when air is passed from said interior air chamber through said valve.

2. The garment of claim 1, wherein one of said noise pads is located at each said knee region towards said front of said garment, a reinforcement layer surrounding said outer surface of each of said noise pads being located at said knee regions.

3. The garment of claim 1, wherein a reinforcement layer surrounds said outer surface of each of said noise pads being located at said elbow regions.

4. The garment of claim 1, wherein each said sole region has a rubber layer surrounding said outer surface of said noise pads located at said sole regions for providing a non-slip surface to said sole regions.

5. The garment of claim 1, wherein each of said noise pads is oval shaped.

6. A noise making garment, comprising:

a garment having an exterior, a front, a back, a body portion, a pair of leg portions, and a pair of arm portions;

said body portion having a neck opening and an elongate closable body opening extending from said neck opening in said front of said garment;

each of said leg portions having a knee region, and a foot portion extending therefrom, each said foot portion having a sole region;

each said arm portion having an elbow region and a hand opening;

a plurality of oval shaped noise pads being fixedly coupled to said exterior of said garment, each of said noise pads having an outer surface;

each said noise pad comprising a deformable bladder having a flexible wall for permitting deformation of said bladder, said flexible wall of said bladder defining an interior air chamber for holding air, said flexible wall of said bladder having a valve extending therethrough, said valve permitting the passage of air from said interior air chamber through said valve when said bladder is deformed, said valve including a noise making device for creating an audible sound when air is passed from said interior air chamber through said valve;

a said noise pad being located at each said knee region towards said front of said garment;

a said noise pad being located at each said elbow region towards said back of said garment;

a said noise pad being located at each said sole region;

a reinforcement layer surrounding said outer surface of each of said noise pads being located at said knee and elbow regions; and wherein each sole region has a rubber layer surrounding said outer surface of said noise pads located at said sole regions for providing a non-slip surface to said sole regions.

7. A noise making garment, comprising:

a garment having an exterior, a front, a back, a body portion, a pair of leg portions, and a pair of arm portions, said body portion having a neck opening and an elongate closable body opening extending from said neck opening in said front of said garment, each said leg portion having a knee region and a foot portion extending therefrom, each said foot portion having a sole region, each said arm portion having an elbow region and a hand opening;

a plurality of noise pads being fixedly coupled to said exterior of said garment, each of said noise pads having an outer surface;

wherein one of said noise pads is located at each said elbow region towards said back of said garment;

wherein one of said noise pads is located at each said knee region towards said front of said garment;

wherein each said noise pad comprises a deformable bladder having a flexible wall for permitting deformation of said bladder;

said flexible wall of said bladder defining an interior air chamber for holding air;

said flexible wall of said bladder having a valve extending therethrough, said valve permitting the passage of air from said interior air chamber through said valve when said bladder is deformed; and said valve including a noise making device for creating an audible sound when air is passed from said interior air chamber through said valve.

8. The garment of claim 7, wherein a reinforcement layer surrounds said outer surface of each of said noise pads being located at said knee regions.

9. The garment of claim 7, wherein a reinforcement layer surrounds said outer surface of each of said noise pads being located at said elbow regions.

10. The garment of claim 7, wherein one of said noise pads is located at each said sole region, wherein each sole region of said foot portion has a rubber layer surrounding said outer surface of said noise pads located at said sole regions for providing a non-slip surface to said sole regions.

11. The garment of claim 7, wherein each of said noise pads is oval shaped.

* * * * *